US009682413B2

(12) United States Patent
Spink

(10) Patent No.: US 9,682,413 B2
(45) Date of Patent: Jun. 20, 2017

(54) INTERNAL ROLLER SWAGING DEVICE AND METHOD

(71) Applicant: Eaton Corporation, Cleveland, OH (US)

(72) Inventor: Kenneth M. Spink, Horton, MI (US)

(73) Assignee: Eaton Corporation, Cleveland, OH (US)

( * ) Notice: Subject to any disclaimer, the term of this patent is extended or adjusted under 35 U.S.C. 154(b) by 425 days.

(21) Appl. No.: 14/175,580

(22) Filed: Feb. 7, 2014

(65) Prior Publication Data

US 2014/0150230 A1 Jun. 5, 2014

Related U.S. Application Data

(63) Continuation-in-part of application No. 12/982,237, filed on Dec. 30, 2010, now Pat. No. 8,683,839.

(51) Int. Cl.

| | |
|---|---|
| ***B21D 39/04*** | (2006.01) |
| ***B21D 39/20*** | (2006.01) |
| ***B21D 39/10*** | (2006.01) |
| ***B21D 39/16*** | (2006.01) |
| ***B21D 41/02*** | (2006.01) |
| ***B21D 39/03*** | (2006.01) |
| ***B21D 53/88*** | (2006.01) |
| *B21D 26/14* | (2006.01) |

(52) U.S. Cl.

CPC ..... *B21D 39/04* (2013.01); *B21D 39/03* (2013.01); *B21D 39/046* (2013.01); *B21D 39/10* (2013.01); *B21D 39/16* (2013.01); *B21D 39/20* (2013.01); *B21D 41/026* (2013.01); *B21D 53/88* (2013.01); *B21D 26/14* (2013.01); *Y10T 29/53722* (2015.01)

(58) Field of Classification Search

CPC ..... B21D 39/04; B21D 39/20; B21D 39/10; B21D 39/08; B21D 39/16; B21D 39/06; B21D 41/026; B21D 41/028

See application file for complete search history.

(56) References Cited

U.S. PATENT DOCUMENTS

| | | | | | |
|---|---|---|---|---|---|
| 353,425 | A | | 11/1886 | McHale | |
| 1,514,712 | A | | 11/1924 | Maupin | |
| 2,471,614 | A | * | 5/1949 | Gilman | B21D 39/16 464/172 |
| 3,585,701 | A | | 6/1971 | Stary | |
| 3,854,314 | A | * | 12/1974 | Martin | B21D 39/06 29/715 |
| 4,239,713 | A | | 12/1980 | Brif et al. | |
| 4,602,492 | A | * | 7/1986 | Brif | B21D 39/16 72/10.1 |
| 4,658,616 | A | | 4/1987 | Bastone | |

(Continued)

FOREIGN PATENT DOCUMENTS

| | | |
|---|---|---|
| JP | 63-286216 | 11/1988 |

*Primary Examiner* — Moshe Wilensky
*Assistant Examiner* — Mohammad Yusuf
(74) *Attorney, Agent, or Firm* — Fishman Stewart PLLC

(57) ABSTRACT

An exemplary device and method for roller swaging a tube and a fitting includes a controller configured to terminate swaging in response to receiving a signal generated by a torque sensor. The torque sensor is configured to generate the signal indicative of a torque rise associated with a flow of tube material consisting of flow in an axial direction through a front or a rear of the fitting.

20 Claims, 3 Drawing Sheets

(56) References Cited

U.S. PATENT DOCUMENTS

| | | | | |
|---|---|---|---|---|
| 4,793,167 | A * | 12/1988 | Beiley | B21D 39/04<br>72/122 |
| 5,040,396 | A | 8/1991 | Mikhail et al. | |
| 6,003,237 | A | 12/1999 | Sarr et al. | |
| 6,354,123 | B1 | 3/2002 | Rajagopalan et al. | |
| 6,691,542 | B2 | 2/2004 | Fukukawa et al. | |
| 7,490,499 | B2 | 2/2009 | Suzuki et al. | |

* cited by examiner

INTERNAL ROLLER SWAGING DEVICE AND METHOD

CROSS REFERENCE TO RELATED APPLICATION

This application is a Continuation-in-Part application of U.S. patent application Ser. No. 12/982,237, filed Dec. 30, 2010. The content of the above-mentioned application is hereby expressly incorporated by reference in its entirety.

BACKGROUND

Roller swaging of hydraulic tubing as a method of attaching fittings is a common practice in the aerospace industry. To roller swage a fitting to a tube, the end of a mandrel and roller swaging assembly expander assembly is inserted into the tube and a fitting to be swaged onto the tube is placed on the tube. The end of the expander assembly swage rollers expand outward and inward according to the axial position of the mandrel. The rotating tapered mandrel is moved along the axis of the expander assembly and frictionally engages the rollers and forces the rollers against the inner wall of the tube. The mandrel continues to rotate and move axially to expand the roller working diameter forcing tube material to flow into grooves in the fitting to produce a strong sealed connection between the tube and the fitting.

The rollers that support the mandrel through a support cage are tapered or can be angled so that their rotational axis is at a relative angle to the rotational axis of the mandrel which produces an axial force on the mandrel as it is rotated. The mandrel moves axially inward when the mandrel is rotated in one direction and the mandrel moves axially outward when the mandrel is rotated in an opposite direction. This prevents custom swaging since the swage rollers cannot be held and rotated in one axial position since they start axially moving as soon as the mandrel is rotated. Also, burnishing is not possible using this prior art device.

As part of the swaging process, the inside diameter of the tube is checked after swaging to confirm that specifications are satisfied. This prior art process adds significant time because the operator must remove the swaged assembly from the swaging machine and then make the measurement using a micrometer to confirm that the inside diameter of the tube meets specifications for a good quality swage. If the measurements do not meet the specifications, then the piece must be re-worked or discarded.

SUMMARY

The exemplary roller swaging machine provides for the swaging of a tube and fitting to an accurate dimension by using the position of the mandrel and the geometry of the swage rollers to measure the inside diameter and wall thickness of the tube to be swaged. This is accomplished by directly or indirectly determining the axial position of the mandrel by measuring the position of a drive head relative to the ground support and/or measuring the position of the mandrel directly. If support roller bearings are used that have roller elements that are parallel to the mandrel, the mandrel moves with the drive head and the mandrel position can be measured by a position sensor either at the drive head or at the mandrel itself. If a prior art type of support roller bearing is used, then the position of the mandrel must be measured at the mandrel since the mandrel will move axially as it is rotated independent of the position of the drive head.

The process of swaging the tube involves loading the tube and its associated fitting into the roller swaging assembly. The mandrel is axially moved by the rack drive head or by the rotation of the mandrel (if prior art type support roller bearings are used) until a torque sensor on the output of the drive motor indicates that the swage rollers have contacted the inside diameter of the tube. The position of the rack drive head or the mandrel is measured and the tubing wall thickness is calculated by a controller and the amount of swaging to perform to generate a proper swage joint between the tube and the fitting is determined. The mandrel is then withdrawn from the swage and then inserted into the tube by the movement of the rack drive head and/or the rotation of the mandrel until once again the torque sensor on the drive motor indicates that the swage rollers have contacted the inside wall of the tube at the swage. The output of the position sensor(s) either at the drive head or at the mandrel then is used to calculate the geometry of the swage to qualify its quality.

In one exemplary swaging machine, the rollers that support the mandrel are parallel to the axis of the mandrel and the cage and the result is that the mandrel can be rotated without an axial force generated by the support rollers. This feature provides the capability to perform additional swaging or burnishing without changing the speed of the drive motor and mandrel. Custom swaging processing is therefore possible using the exemplary roller swaging machine as disclosed herein. Note that it is not required to utilize mandrel support roller bearings having parallel roller elements to make use of the method disclosed herein to determine the quality of the swage since measurement of the position of the mandrel when the swaging rollers just touch the inside of the tube both before and after the swage is all that is needed to determine the quality of the swage. In an alternate configuration, the support rollers have angled roller elements so that the position sensor must sense the position of the mandrel directly while a torque transducer on the output of the drive motor is used to determine when the swaging rollers contact the inside of the tube both before and after the swaging process.

DETAILED DESCRIPTION

Figure 1:
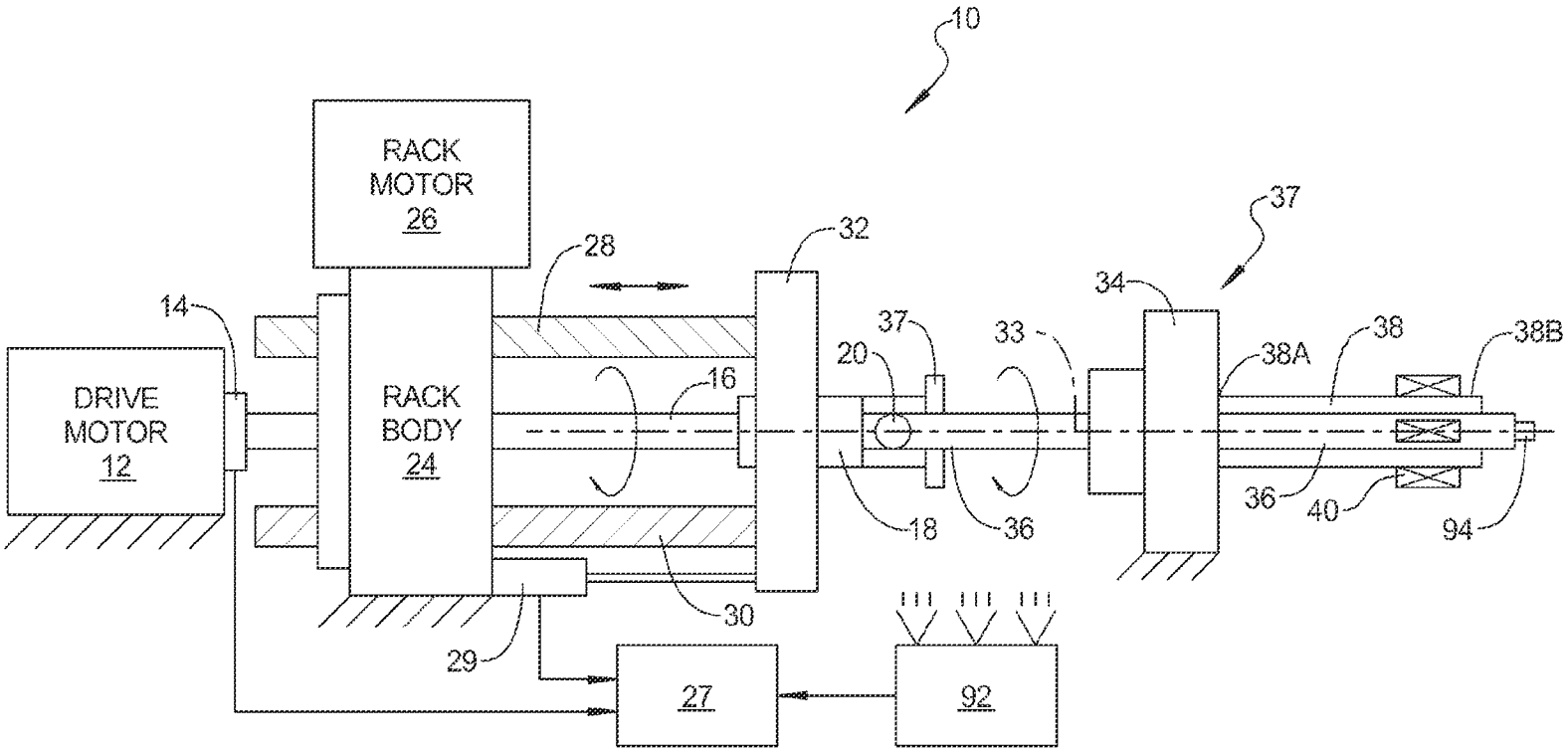
FIG. 1 is a plan view of the exemplary internal roller swaging device.

Referring now to the discussion that follows and also to the drawings, illustrative approaches to the disclosed systems and methods are shown in detail. Although the drawings represent some possible approaches, the drawings are not necessarily to scale and certain features may be exaggerated, removed, or partially sectioned to better illustrate and explain the present disclosure. Further, the descriptions set forth herein are not intended to be exhaustive or otherwise limit or restrict the claims to the precise forms and configurations shown in the drawings and disclosed in the following detailed description.

Moreover, a number of constants may be introduced in the discussion that follows. In some cases illustrative values of the constants are provided. In other cases, no specific values are given. The values of the constants will depend on characteristics of the associated hardware and the interrelationship of such characteristics with one another as well as environmental conditions and the operational conditions associated with the disclosed system.

Now referring to FIG. 1 of the drawings, a plan view of an exemplary internal roller swaging machine 10 is shown. The swaging machine 10 has a drive motor 12 connected to a torque sensor 14 that is then connected to a primary drive shaft 16. The primary drive shaft 16 is connected to a drive hub coupling 18. The drive hub 18 is connected to a rotating drive coupling 20 which rotates a mandrel 36. Thus, the drive motor 12 rotates the primary drive shaft 16, the drive hub 18, the drive coupling 20 and the mandrel 36.

The rack body 24 is axially positioned by a rack motor 26. Typically, the drive motor 12 and the rack motor 26 are variable speed motors. The torque sensor 14 is connected to a controller 27 where the controller 27 is a microprocessor based control system. A position sensor 29 is attached mechanically to the rack body 24 and the drive head 32 so as to measure the travel of the drive head 32 as the lead screws 28, 30 are rotated by the rack motor 26. The axial travel of the drive head 32 equates to the axial travel of the swaging mandrel 36. Disposed around the swaging mandrel 36 is a cage 38 which is supported by the roller swaging assembly 34 at a first end 38A and by support rollers 40 at a second end 38B.

The rollers 40 are preferably tapered rollers, although other types of bearings can be used. As shown in this embodiment, the centerline of the roller elements of the support rollers 40 are parallel to the central axis 33 of the cage 38, there is no axial force generated when the cage 38 is rotated by the secondary shaft 22. Since there is no driving force generated, the axial position of the mandrel 36 does not change appreciably when rotation is applied to mandrel 36 but only when the drive head 32 is axially moved by rotation of the lead screws 28, 30. The mandrel 36 and the swage rollers 40 residing inside the roller swaging assembly 34 comprise the forming assembly 37. The forming rollers 40 swage the inside of the tube to the overlying fitting when the mandrel 36 is rotated by the drive head 18 and axially moved by the axial movement of the drive head 32. In the prior art, the mandrel 36 would be axially moved by the forces induced by angled rollers when the mandrel 36 is rotated.

Figure 3B:
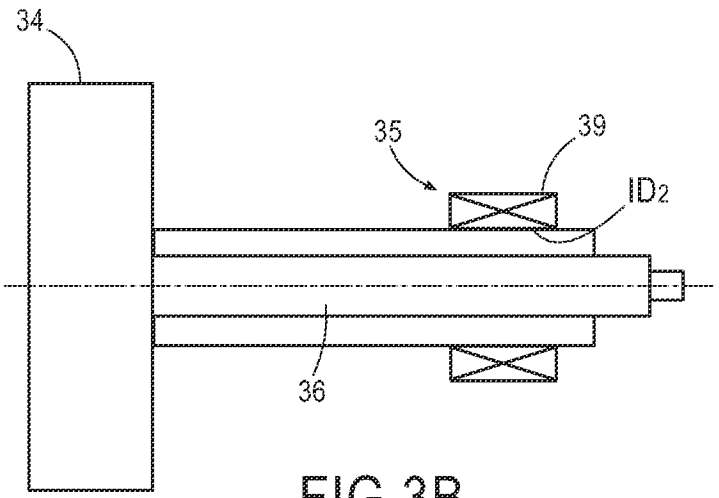
FIG. 3B is a schematic representation of an exemplary second calibrated ring having an known inner diameter of the swaging device of FIG. 3A, and the swaging device uses the first and second calibrated rings to calibrate or correspond an axial position of a mandrel with a working outer diameter of swage rollers.
Figure 3A:
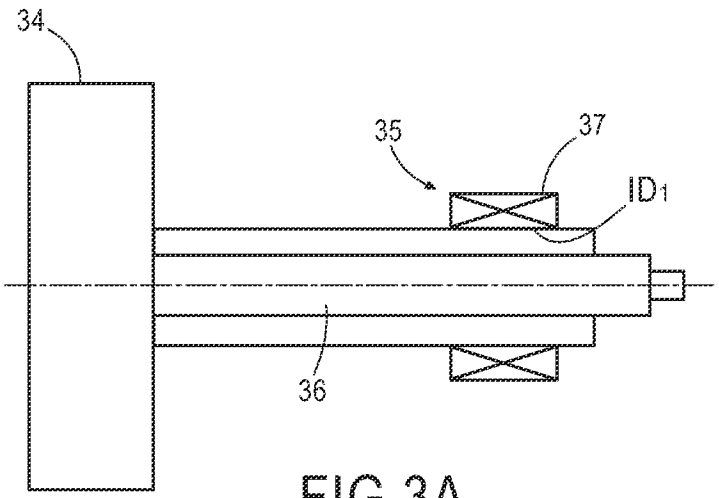
FIG. 3A is a schematic representation of an exemplary first calibrated ring having an known inner diameter of the swaging device of FIG. 1.

Before the machine 10 can run a cycle, the machine 10 is initialized and calibrated by, for example, determining a relationship between the axial position of the mandrel 36 and the working OD of the rollers 40. At the outset, the swaging assembly 34 can be installed into the machine 10 and a set of two or more calibrated rings (FIGS. 3A and 3B) having respectively known IDs may be used to determine the relationship between the axial movement of the mandrel 36 and the OD of the working rollers 40 that swage the tube ID. In particular, the calibrated rings 35 can include a first calibrated ring 37 having a first known ID and a second calibrated ring 39 having a second known ID, which may be greater than the first known ID. The controller 27 can receive a plurality of signals from a user interface 41, with the signals being indicative of the first and second known IDs. In addition, the position sensor 29 can detect and generate a signal indicative of the axial position of the swaging assembly 34 into the ring 37 as the mandrel is pushed forward without rotation. The rollers 40 can expand until they contact the first ring 37, and the controller can determine the instant axial position. The process can then be repeated with the rollers expanding until they contact the second ring 39, and the controller determines the instant axial position. Based on the instant axial positions and corresponding OD surfaces of the rollers 40, the controller can determine a linear relationship between the axial position of the mandrel 36 and the working OD of the rollers 40.

The controller 27 uses an algorithm to determine when the swaging rollers inside the roller swaging assembly 34 contact the inside diameter of the tube based on the signal generated by the torque sensor 14. As soon as the rotational drive torque of the primary drive shaft 16, as measured by torque sensor 14, exceeds a threshold level, the controller 27 uses the read out of the position sensor 29 to determine the position of the rack drive head 32. These two parameters are then used by the controller 27 to determine the wall thickness of the tube and then determine the process to use to swage the tube to the fitting.

After the swaging process is complete, a post swage quality check can then be made by powering and axially moving the rack drive head 32 with the rack motor 26 until the signal from the torque sensor 14 indicates that the swaging rollers 40 have been expanded to contact the inside wall of the tube (not shown). Then the position of the rack drive head 32 and thus, the position of the mandrel 36 can be used by the controller 27 to calculate the final swage tube inner diameter. If the inner diameter of the tube at the swage falls within a calculated range, then the swaged joint is acceptable.

Two position sensors 29 and 92 are shown in FIG. 1. Both can be used to measure the axial position of the mandrel 36 although only one position sensor is required to regulate the swaging process. The position sensor 92 optically senses the position of the mandrel 36 by reflections off of a reflecting surface 37 so it potentially generates a more accurate position signal representing the position of the mandrel 36. It is also possible to connect a position sensor directly to the far end of the mandrel 36 through mandrel connector 94.

In calculating the quality of the swage, the mandrel 36 is moved to a position when the swaging rollers contact the inside of the tube and the output of the position sensor (either 29 or 92) is measured. Based on this position signal, the quality of the swage can be calculated by the controller 27. The correction factor for wall thickness is calculated using the below formula that adjusts a pre-qualified after swage inner diameter. The controller 27 uses the algorithm to swage to the correct projected inner diameter, then confirms the actual "after swage" dimension.

For example:

Interpretation of the I.D. After-Swage Criteria (cont.).

Example for size –04016:

Nominal tube wall 0.016"

Actual tube wall 0.0155"

Measured ID=0.230"

Corrected ID=0.230–(0.016–0.0155×2)=0.228"

Figure 2:
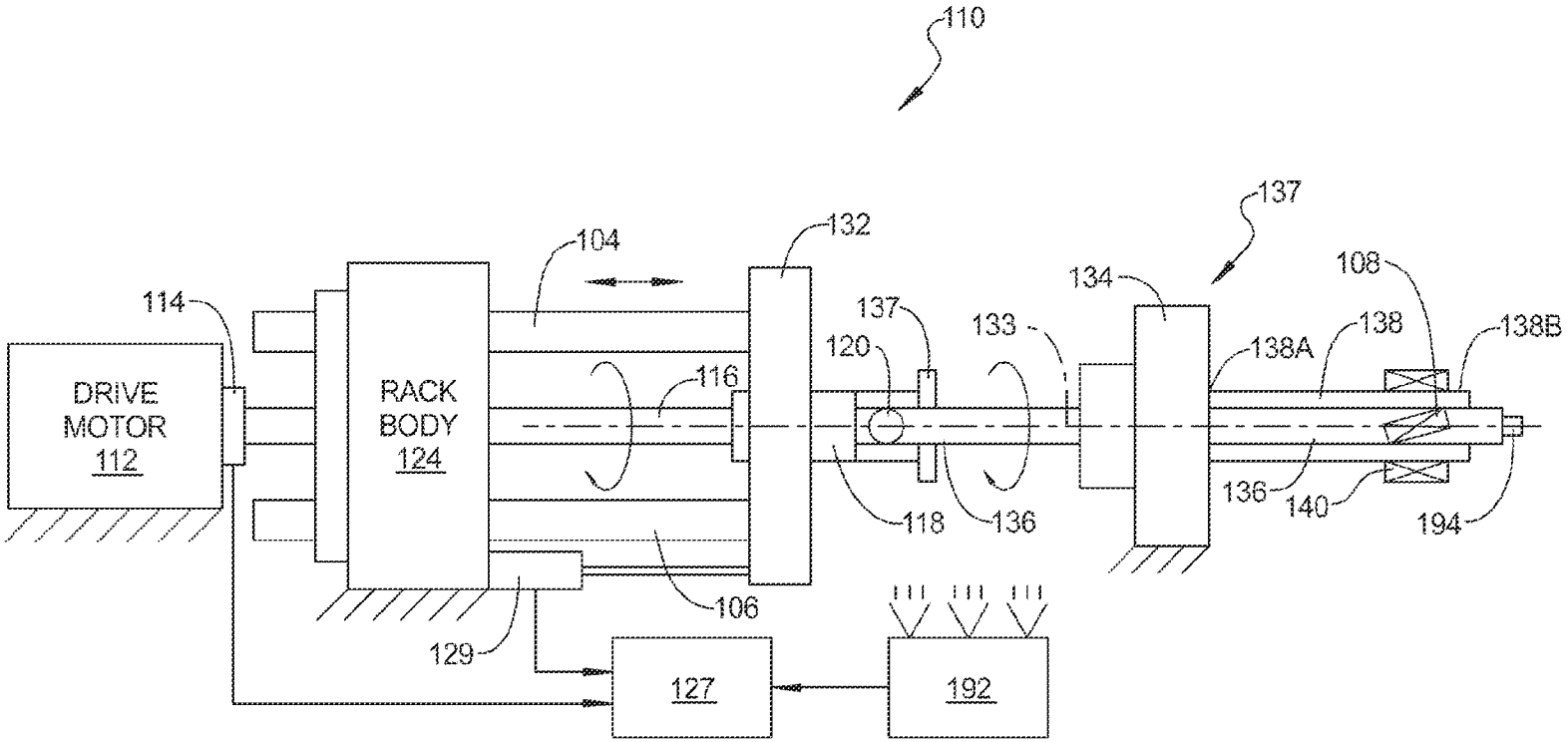
FIG. 2 is a plan view of an alternative embodiment of the exemplary internal roller swaging device.

Now referring to FIG. 2 of the drawings, an alternative embodiment of the exemplary internal roller swaging device 110 is shown. This particular embodiment is a more basic version of the internal roller swaging device 10 as shown in FIG. 1 in that the mandrel 136 position is now axially controlled by rotation of the mandrel 136 on the support rollers 140 instead of by the position of the drive head 132. In the swaging device 110 shown in FIG. 2, the rollers 140 are prior art support rollers having roller elements 108 that are angled to the central axis 133 of the mandrel 136 so that the mandrel 136 is forced axially inward or outward when it is rotated by the drive motor 120. In FIG. 1 the rollers 140 are arranged to be parallel to the central axis 133 of the mandrel 136 whereas in FIG. 2, the rollers 140 have roller elements 108 that are angled to the central axis 133 which results in an axial force being applied to the mandrel 136.

Prior art air cylinders 104, 106 are only used to initially move the mandrel 136 inward so that the swaging rollers 140 of the roller swaging assembly 137 contact the inside of the tube that is to be swaged. A position sensor 129 is shown mounted to the rack body 124 and to the drive head 132 so that the position of the drive head 132 can be monitored. This feature allows for control of the air cylinders 104, 106 by a controller 127. After the tube and fitting are mounted in the roller swaging forming assembly 134 and the mandrel 136 inserted to form the forming assembly 137, the mandrel 136 is drawn into the expander bearing assembly 134 until the force sensor 114 detects an increase in drive torque out of the drive motor 112 indicating that the mandrel 136 and attached swaging rollers 140 have contacted the inside of the tube. At that point the position of the mandrel 136 is measured with the position sensor 192 which optically interacts with the reflecting surface 137 mounted on the mandrel 136, through the position of the mandrel 136. Then, the swage is made by the axial force generated by the rollers 140 having angled roller elements 108 as the mandrel 136 is rotated.

In this alternative system, the position sensor 192 can be of the optical type shown in FIG. 2 where it is disconnected from but directly senses the position of the rotating mandrel 136 by sensing a reflection from a reflecting surface 137. In this case, the measurement of the position of the mandrel 136 is more directly measured and should be more accurate.

The position of the mandrel 136 after the swage is measured and this information and the position information regarding the position of the mandrel 136 prior to the swage is used by the controller 127 to calculate the quality of the swage and then displays that to an operator. If the swage is satisfactory, then the part is moved for further processing. If not, then it must be re-worked or discarded.

The swaging machine 110 has a drive motor 112 connected to a torque sensor 114 which is then connected to a primary drive shaft 116. The primary drive shaft 116 is connected to a drive hub drive hub 118. The coupling drive hub 118 is connected to a rotating drive coupling 120 which rotates the mandrel 136. Thus, the drive motor 112 rotates the primary drive shaft 116, the drive hub 118, the drive coupling 120 and the mandrel 136 and cage 138 which align the angled rollers 140.

The rack body 124 supports a pair of air cylinders 104, 106 which, when energized, move the drive head 132. Typically, the drive motor 120 is a variable speed motor. The air cylinders 104, 106 are used to initially move the mandrel 136 until the swaging rollers 140 contact the inside of the tube. Then the mandrel 136 is rotated by the drive motor 112 and the rollers 140 with angled roller elements 108 cause the mandrel 136 to axially move into the tube causing the swaging rollers to expand and perform the swaging action between the tube and the fitting in the forming assembly 137. The torque sensor 114 is connected to a controller 127 where the controller 127 is a microprocessor based control system. A position sensor 129 is attached mechanically to the rack body 124 and the drive head 132 so as to indirectly measure the travel of the drive head 132 as the air cylinders 104, 106 and the angled rollers 140 cause the mandrel 136 to move into or out of the forming assembly 137. The optical position sensor 192 is optically coupled to the reflecting surface 137 to read the position of the mandrel 136 and transmits this information to the controller 127. In the alternative, a traditional position sensor can be attached directly to the mandrel 136 by using the mandrel connector 194.

Disposed around the swaging mandrel 136 is a cage 138 which aligns the rollers 140. The support rollers 140 is shown as a non-tapered roller bearing having roller elements 108 that have a rotating axis at a relative angle to the central axis 133 of the mandrel 136 although other bearing types such as a tapered roller bearing may be utilized. Since the centerline of the roller elements 108 are angled to the central axis 133 of the cage 138 and mandrel 136, there is an axial force generated when mandrel 136 is rotated by the drive hub 118. Since there is a significant axial force generated, the position of the mandrel 136 changes depending on the direction and rotational speed of the mandrel 136. The mandrel 136 and the swage rollers 140 residing inside the roller swaging assembly 134 and comprise the forming assembly 137. The rotating swaging assembly 134 swages the inside of the tube to the overlying fitting when the mandrel 136 is axially moved by the axial force generated by the support rollers 140.

The controller 127 uses an algorithm to determine when the swaging rollers located inside the roller swaging assembly 134 contact the inside diameter of the tube based on the signal generated by the torque sensor 114. As soon as the rotational drive torque of the primary drive shaft 116 as measured by torque sensor 114 exceeds a threshold level, the controller 127 uses the read out of the position sensor 192 to determine the position of the mandrel 136. This position information is then used by the controller 127 to determine the inside diameter and wall thickness of the tube and then to determine the process to use to swage the tube to the fitting.

After the swaging process is complete, a post swage quality check can then be made by moving the mandrel 136 by rotating the mandrel 136 outward and then inward until the signal from the torque sensor 114 indicates that the swaging rollers 140 have been expanded to contact the inside wall of the tube or move the mandrel 136 forward with no rotation and measure the position as it comes to rest against the tube inner diameter. Then the position of the mandrel 136 can be used by the controller 127 to calculate the thickness of the tube. If the inner diameter of the tube at the swage falls within a given range, then the swaged joint is acceptable and post forming operations can commence. For example see the discussion of the determination of the quality of the swage made with respect to FIG. 1.

In another exemplary embodiment, the machine 10 can be configured to execute an alternate sequence of programming to swage to a desired corrected post-swage ID (PSID), which accounts for variations in wall thickness, tube OD and fitting ID. In particular, an operator may use the interface to manually input the correction factors to the machine which alters the target PSID that the rollers 40 are set to swage. The correction factors can be the same for an entire lot of raw material. In this respect, the controller can be configured to actuate the rollers 40 to swage the tube to a corrected PSID in response to one or more inputted correction factors. In one non-limiting example, when the operator measures the tube OD and determines that it is 0.001 inches larger than the nominal range, the operator can use the interface to input this data, and the controller can be configured to actuate the rollers 40 to swage the tube OD to 0.001 inches less than the desired PSID, as this correction factor will be added back in after the swage is completed. The result is that one or more of the correction factors, including any spring back factors, can be used to predict the initial diameter to swage to that will result in the corrected PSID.

In yet another exemplary embodiment, the machine 10 can be configured to use mandrel sensor feedback information and/or the torque sensor input to determine a torque rise consisting of axial flow of the tube, and the controller may be configured to terminate the swaging process in response to the torque rise. In particular, the torque sensor can be configured to monitor the torque rise near the end of swage, which can be detected by diameter feedback or torque values. During the swage process, the rollers 40 engage the tube ID and expand it radially outward. A first torque corresponds to the rollers 40 expanding the tube until it contacts the fitting ID. This takes a low amount of torque to move the tube until it contacts the fitting ID and starts to fill a plurality of intended grooves or cylindrical voids, which are formed in the fitting ID and configured to receive a flow of tube material as the tube is swaged to the fitting. A torque corresponding to the rollers 40 as the tube is in a yielding mode and the tube material is flowing into the grooves radially, rises somewhat gradually. When the grooves are full and further radial expansion of the tube into the grooves is no longer possible, the tube material must then flow only axially out the front or rear of the fitting. This axial movement is much harder to flow the tube material and results in an immediate and rapid torque rise. The torque sensor is configured to generate a signal indicative of torque rise, and the controller receives this signal from the sensor and shuts off the rollers 40 in response to the signal. In this respect, it is unnecessary for an operator to use the interface to input variation of component dimensions upon which correction factors would be determined and utilized for determining shutoff points for the swaging process. The result is a swage that is based on the direct objective of filling of grooves fully without over swaging, instead of calculating dimensions and variables of components to determine if there has been enough tube expansion to fill the grooves.

The present disclosure has been particularly shown and described with reference to the foregoing illustrations, which are merely illustrative of the best modes for carrying out the disclosure. It should be understood by those skilled in the art that various alternatives to the illustrations of the disclosure described herein may be employed in practicing the disclosure without departing from the spirit and scope of the disclosure as defined in the following claims. It is intended that the following claims define the scope of the disclosure and that the method and apparatus within the scope of these claims and their equivalents be covered thereby. This description of the disclosure should be understood to include all novel and non-obvious combinations of elements described herein, and claims may be presented in this or a later application to any novel and non-obvious combination of these elements. Moreover, the foregoing illustrations are illustrative, and no single feature or element is essential to all possible combinations that may be claimed in this or a later application.

I claim:

1. A swaging device for swaging a tube and fitting comprising:

a drive mechanism including a drive motor;

a mandrel having a central axis and rotated by said drive mechanism;

a drive head disposed between the drive mechanism and the mandrel;

a position sensor, positioned axially along the central axis of the mandrel, for measuring an axial position of said mandrel; and a controller configured to calculate a final swage inner diameter of a tube based on a measurement of the axial position of the mandrel.

2. The swaging device of claim 1, further comprising a second position sensor for detecting an axial movement of said drive head with respect to a fixed position.

3. The swaging device of claim 2, wherein said controller receives inputs from said second position sensor detecting the movement of said drive head and said position sensor measuring an axial position of said mandrel.

4. The swaging device of claim 1, wherein said drive mechanism includes a rack body, both said drive motor and said rack body being fixed in space, an adjustment mechanism disposed between the rack body and the drive head for axially moving the drive head.

5. The swaging device of claim 4, wherein said adjustment mechanism comprises one of an air cylinder and a lead screw.

6. The swaging device of claim 4, a primary drive shaft connected to said drive motor and extending through the rack body and through said drive head, a drive hub and a drive hub coupling disposed between an end of said primary drive shaft and a corresponding end of said mandrel.

7. The swaging device of claim 6, a support bearing for supporting an opposing end portion of the mandrel, said support bearing having a plurality of support elements.

8. The swaging device of claim 7, wherein said support elements have a rotational axis one of parallel to and at a relative angle to a rotational axis of said mandrel.

9. The swaging device of claim 7, a swaging assembly disposed between said two ends of the mandrel, said swaging assembly including expandable swage rollers configured to contact the inside of a received tube, said swaging assembly being fixed in space.

10. The swaging device of claim 9, wherein a torque sensor positioned between said drive motor and said primary drive shaft is used to determine when said swage rollers contact the inside of a received tube.

11. The swaging device of claim 9, a forming assembly comprising said swage rollers of said swaging assembly and said mandrel, said mandrel moving relative to said swaging assembly to swage a component in cooperation with said swage rollers.

12. The swaging device of claim 7, a cage disposed between said swaging assembly and said support elements and surrounding said mandrel, the drive motor selectively rotating said cage.

13. The swaging device of claim 1, the mandrel including a reflective surface for facilitating measurement of axial position using said position sensor.

14. The swaging device of claim 1, wherein the controller is further configured to calculate the quality of the swage based on a comparison of the actual wall thickness to a range of acceptable thicknesses.

15. A swaging device comprising:

a roller swaging assembly configured to receive a fitting with an inserted tube, said roller swaging assembly including expandable swage rollers;

a mandrel having a central axis and extending through said roller swaging assembly;

a forming assembly including said mandrel and said expandable swage rollers; an axial movement of said mandrel in combination with said swage rollers facilitating a swaging of said received tube;

a position sensor positioned axially along the central axis of the mandrel;

a relative axial position of said mandrel to the roller swaging assembly being measured using said position sensor; and a controller configured to calculate an actual wall thickness of the tube based on the measurement of the axial position.

16. The swaging device of claim 15, further comprising a controller configured to calculate the quality of the swage based on a comparison of the actual wall thickness to a range of acceptable thicknesses.

17. A device for swaging a tube and a fitting to one another, the device comprising:

a drive mechanism including a drive motor;

a mandrel having a central axis and rotated by said drive mechanism to swage the tube and fitting to one another;

a drive head disposed between the drive mechanism and the mandrel;

a position sensor, positioned axially along the central axis of the mandrel, for measuring an axial position of said mandrel; and a controller configured to terminate swaging in response to receiving a signal generated by a torque sensor, and configured to calculate an actual wall thickness of the tube based on an axial position of the mandrel as determined from the position sensor;

wherein the torque sensor is configured to generate the signal indicative of a torque rise associated with a flow of tube material consisting of flow in an axial direction along the fitting.

18. The device of claim 17, further comprising:

a first calibrated ring having a first inner diameter;

a second calibrated ring having a second inner diameter that is greater than the first inner diameter;

the position sensor configured to generate a plurality of signals indicative of a first axial position of the mandrel and a second axial position of the mandrel;

wherein the mandrel in the first axial position expands a plurality of rollers into contact with the first calibrated ring;

wherein the mandrel in the second axial position expands the plurality of rollers into contact with the second calibrated ring; and wherein the controller determines a relationship between an axial position of the mandrel and an outer diameter of the rollers based on the first and second axial positions and the respective first and second inner diameters.

19. The device of claim 17, further comprising:

a user interface coupled to the controller and configured to receive input indicative of a variation of at least one of a wall thickness of the tube, a tube outer diameter and a fitting inner diameter from a nominal desired range;

wherein the controller is configured to determine a correction factor based on the variation and actuate the rollers to produce a corrected post swage inner diameter based on the correction factor.

20. The swaging device of claim 18, further comprising a second position sensor for detecting an axial movement of said drive head with respect to a fixed position.

* * * * *